US005886322A

United States Patent [19]

Rivera Mendoza et al.

[11] Patent Number: 5,886,322

[45] Date of Patent: Mar. 23, 1999

[54] ASSEMBLY OF AN ELECTRICAL CONTACT TERMINAL IN AN ELECTRICAL APPLIANCE

[75] Inventors: Jose Manuel Rivera Mendoza; Ruben Lopez Escalante, both of Queretaro, Mexico; George M Drizos, Cheshire, Conn.

[73] Assignee: Black & Decker Inc., Newark, Del.

[21] Appl. No.: 585,851

[22] Filed: Jan. 16, 1996

[51] Int. Cl.[6] ..... D06F 75/08

[52] U.S. Cl. ..... 219/256; 38/74; 439/741

[58] Field of Search ..... 219/256, 247, 219/250, 541; 38/74, 82; 439/84, 741, 743, 870

[56] References Cited

U.S. PATENT DOCUMENTS

| | | | |
|---|---|---|---|
| 2,140,756 | 12/1938 | Lobstein . | |
| 2,666,125 | 1/1954 | Carpenter | 219/256 |
| 2,722,625 | 11/1955 | Bingeman et al. | 439/870 |
| 3,348,191 | 10/1967 | Kinkaid | 439/741 |
| 3,399,371 | 8/1968 | Inacker | 439/741 |
| 3,644,066 | 2/1972 | Heob et al. | 439/870 |
| 3,833,879 | 9/1974 | Aidn et al. | 439/741 |
| 3,880,491 | 4/1975 | Ferro et al. . | |
| 4,646,047 | 2/1987 | Horn et al. | 439/741 |
| 5,079,672 | 1/1992 | Haubner et al. | 361/387 |
| 5,139,443 | 8/1992 | Armando | 439/741 |
| 5,166,570 | 11/1992 | Takahashi | 439/84 |
| 5,221,874 | 6/1993 | Dayton | 313/318 |

FOREIGN PATENT DOCUMENTS 3-148893 6/1991 Japan .

*Primary Examiner*—John A. Jeffery
*Attorney, Agent, or Firm*—Barry E. Deutsch

[57] ABSTRACT

An electric iron having electrical terminals connected to an electrical power cord. At least one of the terminals extends through a slot in a heat insulating skirt at the rear of the soleplate. The terminal substantially blocks the slot. The terminal also has a narrow neck section above the slot The terminal is twisted or bent at the narrow neck section to prevent the terminal from being pushed back through the slot.

3 Claims, 2 Drawing Sheets

ASSEMBLY OF AN ELECTRICAL CONTACT TERMINAL IN AN ELECTRICAL APPLIANCE

BACKGROUND OF THE INVENTION

1. Field of the Invention

The present invention relates to electrical appliances and, more particularly, to an electrical contact terminal.

2. Prior Art

U.S. Pat. No. 2,140,756 discloses an iron with male contacts at its rear that plug into female contacts. U.S. Pat. No. 5,221,874 discloses planar contact terminals introduced through slots in a wall. Other documents that disclose different electrical conductors include Japanese patent publication No. 3-148.893 and U.S. Pat. Nos. 3,880,491 and 5,079,672.

SUMMARY OF THE INVENTION

In accordance with one embodiment of the present invention an electric iron is provided having a soleplate, a heating element, a thermostat, a housing skirt and electrical terminals extending through apertures in the skirt. At least one of the electrical terminals is bent above the skirt to prevent the at least one terminal from being pressed down through its respective aperture into the skirt.

In accordance with one method of the present invention a method of positioning an electrical contact terminal during assembly of an electrical appliance is provided comprising steps of inserting the terminal from a first side of a housing piece of the appliance into a slot in the housing piece, the terminal having a portion that extends out of the slot past a second side of the housing piece; and bending the portion of the terminal after the portion is positioned past the second side of the housing piece to prevent the terminal from being pushed back through the slot.

In accordance with another embodiment of the present invention an electric iron is provided having a soleplate, a heating element, a thermostat, a housing skirt, and electrical terminals extending through apertures in the skirt. The iron includes means for preventing heat from travelling through the skirt proximate the terminals. The means for preventing heat comprises at least one of the terminals substantially blocking its respective aperture and having a narrow neck section located past the skirt to restrict flow of heat through the terminal at the narrow neck.

In accordance with another embodiment of the present invention an electric iron is provided having a soleplate, a heating element, a thermostat, a housing skirt, and electrical terminals extending through apertures in the skirt. The skirt has a raised wall located in front of and above a portion of the skirt that the apertures pass through. The raised wall is located in front of the electrical terminals to support at least one of the terminals when mating terminals are connected in a direction from a rear of the skirt.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
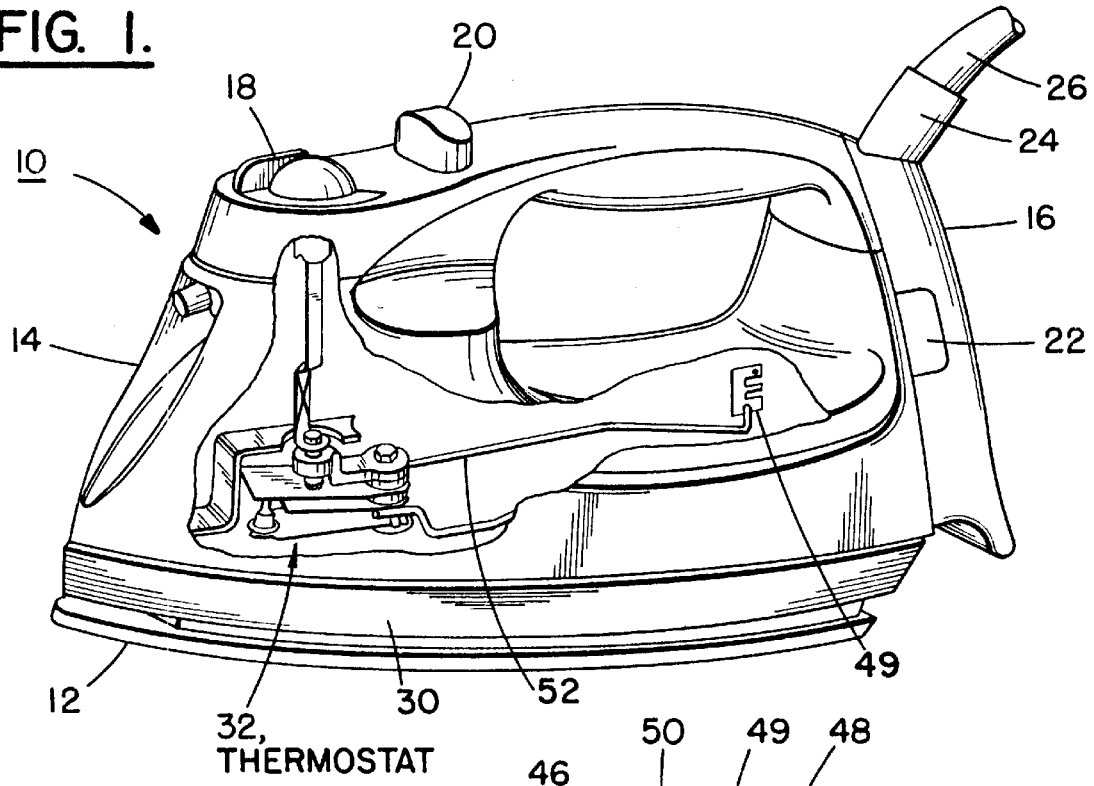
FIG. 1 is a perspective view of an electric steam iron incorporating features of the present invention.

Referring to FIG. 1 there is shown a perspective view of an electric steam iron 10 incorporating features of the present invention. Although the present invention will be described with reference to the single embodiment shown in the drawings, it should be understood that features of the present invention can be embodied in many alternative forms of alternate embodiments. In addition, any suitable size, shape, or type of elements or materials could be used.

Figure 2:
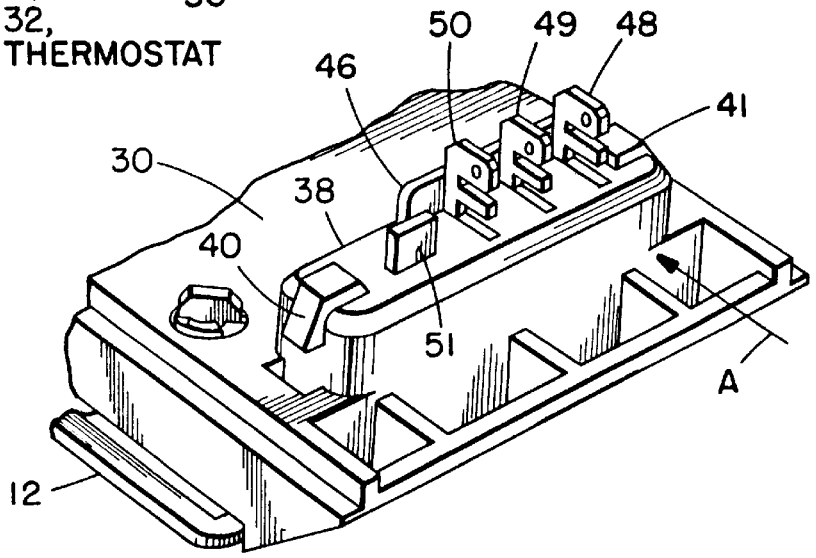
FIG. 2 is a partial perspective view of the rear end of the skirt attached to the soleplate in the iron shown in FIG. 1.
Figure 3:
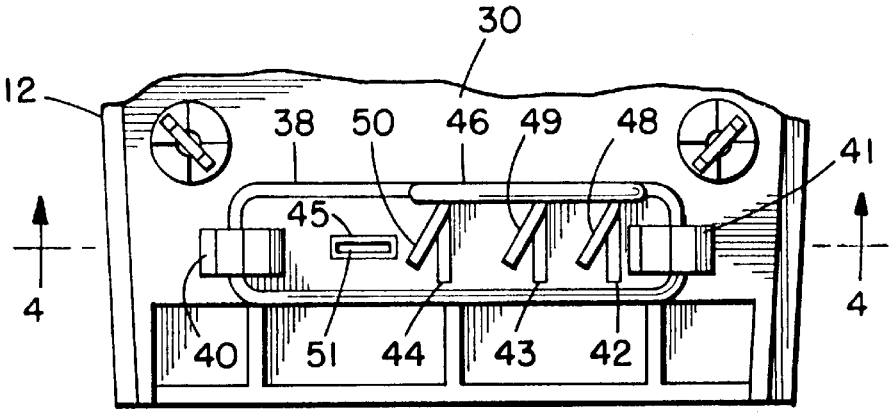
FIG. 3 is a plan top view of the rear end shown in FIG. 2.
Figure 4:
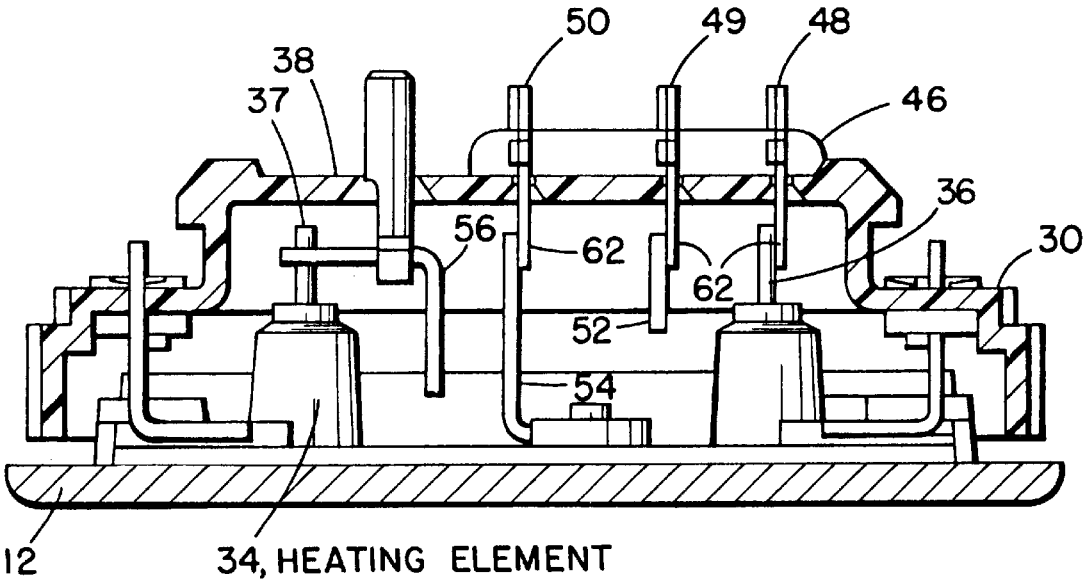
FIG. 4 is a cross-sectional view of the rear end shown in FIG. 3 taken along line 4—4.

The iron 10 generally comprises a soleplate 12, a housing 14 with a rear cover 16, a temperature control knob 18, a steam surge button 20, a reset button 22, an electric cord bushing 24 and an electric cord 26. However, features of the present invention could be incorporated into other types of irons and other types of electrical appliances. The control knob 18 is connected to a thermostat 32 inside the housing 14. The thermostat is mounted on the soleplate 12. Referring also to FIG. 4, the soleplate 12 includes a heating element 34 therein. The heating element 34 has two contact areas or posts 36, 37 that extend up from the soleplate 12 at the rear of the soleplate. The rear cover 16 has the reset button 22 attached to it and houses an electronic module. In the embodiment, the module is an auto-OFF module that has circuitry adapted to automatically turn the iron 10 OFF after a predetermined period of time, such as one hour. The reset button 22 is adapted to depress an actuator of the module to reset the module. However, in alternate embodiments, any suitable type of electronic module or control could be used. In the embodiment shown, the housing includes a heat insulating skirt 30 that is attached to the soleplate 12. Referring to FIGS. 2–4, the skirt 30 has a terminal connection stand 38 at its rear end. The stand 38 includes two snap-lock ledges 40, 41, four contact terminal slots or apertures 42, 43, 44, 45, and a front support wall 46. The two snap-lock ledges 40, 41 are adapted to connect rear end of a water tank (not shown) to the skirt 30. The support wall 46 is located in front of and above the portion of the stand 38 that has the first three slots 42–44. In alternate embodiments the stand could have any suitable shape or need not be provided, but apertures for the terminals should be provided.

The iron 10 has four electrical contact terminals 48, 49, 50, 51. The first terminal 48 is connected to the heating element post 36. The second terminal 49 is connected to the bus bar 52. The bus bar 52 extends to the thermostat 32 (see FIG. 1) in the front of the iron. The third terminal 50 is electrically connected to the soleplate 12 by bus bar 54 to act as a ground terminal. The fourth terminal 51 is connected to bus bar 56. The bus bar 56 extends between the heating element post 37 and the thermostat 32 via an over-temperature limiter (not shown). The terminals 48–51 extend from inside the stand 38, through the slots 42–45, and out past the top side of the stand 38. The fourth terminal 51 is connected to the module inside the iron to signal the user when power is being supplied to the heating element 34. The three other terminals 48–50 are provided to electrically connect the electric cord 26 (see FIG. 1) to the soleplate 12, the heating element 34 and the thermostat 32 via the control module.

Figure 5:
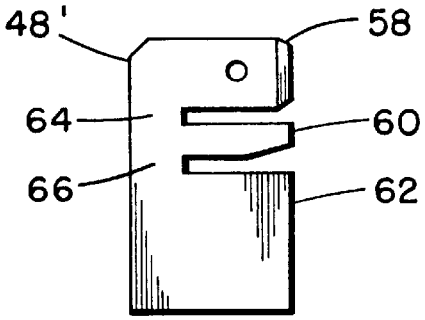
FIG. 5 is an elevational side view of a terminal blank used as a terminal in the iron shown in FIG. 1.

Referring to FIG. 5, a terminal blank 48' is shown that can be used as one of the first three terminals 48–50. The blank 48' is comprised of flat stock metal material. The blank 48' has a top connection arm 58, a middle guide arm 60, a bottom 62, and two narrow neck sections 64, 66. As seen in FIG. 4, the bottoms 62 are connected to the bus bars 52, 54 and post 36, such as by welding. The bottoms 62 extend up into the three slots 42–44. The cross-sectional area of the bottom 62 is substantially the same as the slots 42–44. Therefore, the terminals 48–50 substantially close or block the slots 42–44. However, in alternate embodiments, other types of terminals could be used.

Figure 6B:
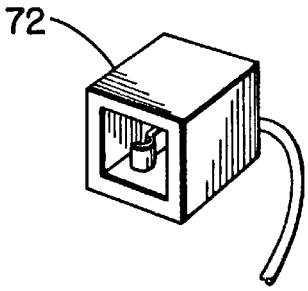
FIG. 6B is a schematic perspective view of an alternate embodiment of a mating connector.
Figure 6A:
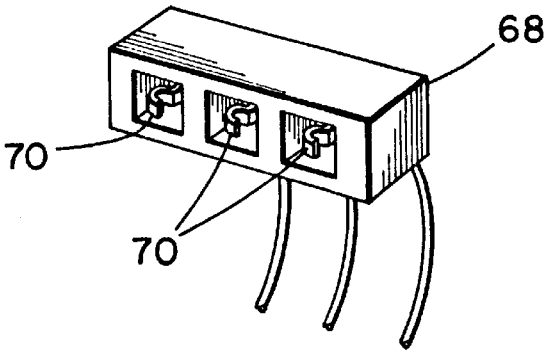
FIG. 6A is a schematic perspective view of a mating connector for attachment to the terminals shown in FIGS. 2–4.

After the skirt 30 is lowered onto the soleplate 12, the three terminals 48–50 are deformed. More specifically, the lower narrow neck section 66 of the terminals 48–50 is bent or axially twisted. As seen best in FIG. 3, the bend is relatively slight; such as about 30°. However, any suitable angle could be used so long as it is enough to move the leading rear edges of the top connection arm 58 and middle guide arm 60 laterally relative to the slots 42–44. The reason the second terminal 49 is bent is to prevent the second terminal 49 from being inadvertently pushed back down through the slot 43 after the skirt 30 has been fixedly attached to the soleplate. More specifically, the relatively long bus bar 52 is deflectable. If the second terminal 49 is accidentally pressed down after the skirt 30 is attached to the soleplate 12, it could potentially allow the bus bar 52 to contact the soleplate or another component and cause an electrical short circuit or, cause other thermal or mechanical problems with other components in the iron. Thus, the skirt would then need to be removed from the soleplate to position the second terminal 49 back into its slot 43. By bending the second terminal 49 at its lower narrow neck 66, the terminal 49 is no longer able to be pushed down through the slot 43 because the lower edge of the guide arm 60 would contact the top surface of the stand 38. Although there is substantially no likelihood that the first and third terminals 42, 44 can be inadvertently pushed down into the skirt, degrading electrical clearance and position for assembly, they are also bent such that the single connector 68 shown in FIG. 6A, with three female contacts 70, can be attached to the three terminals 48–50. In an alternate embodiment, the first and third terminals 48, 50 need not be bent, such as when individual mating connectors, such as connector 72 shown in FIG. 6B, are used.

The terminals 48–50 are suitably sized and shaped to have a mating connectors (s) connected thereto in a direction A (see FIG. 2) from the rear of the skirt 30. The support wall 46 is provided in front of the terminals 48–50 to support the terminals 48–50 during connection of the mating connector (s) in direction A. The lower narrow neck section 66, in addition to allowing the terminals 48–50 to be more easily bent thereat, also provide a heat transfer blocking function. More specifically, heat located under the skirt 30 is going to attempt to flow through the terminals 48–50 to above the skirt 30. The narrow neck sections 66, by having a relatively small cross-sectional area, inhibit or reduce the flow of heat through the sections 66. This, in combination with the terminals 48–50 substantially blocking the slots 42–44, reduces the transfer of heat through the skirt proximate the terminals. This may be important because the electronic control module, located in close proximity to the stand 38, could otherwise be affected by excessive heat. The twisting action also insures that the bottom 62 of the terminals are positioned to block the slots to prevent heat flow. In addition, the twisting action insures that the terminals are positioned to insure that the lower edges of the top arms 58 are unobstructed to allow the female terminal (s) to be inserted onto the top arms 58.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In an electric iron having a soleplate, a heating element, a thermostat, a housing skirt, and electrical terminals extending through apertures in the skirt wherein the improvement comprises at least one of the electrical terminals including a top connection arm, a middle guide arm vertically spaced below the top connection arm, a bottom portion vertically spaced below the guide arm, and a pair of narrow neck sections, the first of said sections being disposed vertically above said guide arm and the other of said narrow neck sections being disposed vertically above said bottom portion, said top connection arm and said guide arm being axially twisted relative to said bottom portion to form an angle of less than 90° in a horizontal plane therebetween, said connection arm receiving a mating female electrical connector placed thereon in a generally horizontal plane.

2. An iron as in claim 1 wherein the skirt includes a support wall located above the apertures and in front of the at least one terminal.

3. An iron as in claim 2 wherein the at least one terminal is suitably sized and shaped to have a female mating contact connected to it in a direction from a rear of the skirt.

* * * * *